US006575714B2

(12) United States Patent
Pace et al.

(10) Patent No.: US 6,575,714 B2
(45) Date of Patent: Jun. 10, 2003

(54) SUBMERSIBLE PUMP AND SPRINKLER SYSTEM

(76) Inventors: Peter Pace, 3600 Edgewood Park Dr., Commerce, MI (US) 48382; Steve McPherson, 10000 McPherson, White Lake, MI (US) 48386

( * ) Notice: Subject to any disclaimer, the term of this patent is extended or adjusted under 35 U.S.C. 154(b) by 0 days.

(21) Appl. No.: 09/895,929

(22) Filed: Jun. 29, 2001

(65) Prior Publication Data

US 2003/0002996 A1 Jan. 2, 2003

(51) Int. Cl.[7] ..... F04B 17/00; F04B 35/00

(52) U.S. Cl. ..... 417/360; 417/423.3; 415/199.4; 310/89

(58) Field of Search ..... 417/360, 422, 417/423.3, 424.1, 359, 361; 310/87, 89; 415/198.1, 199.4

(56) References Cited

U.S. PATENT DOCUMENTS

| | | | | | |
|---|---|---|---|---|---|
| 2,918,016 | A | * | 12/1959 | Olson | 103/87 |
| 3,584,974 | A | * | 6/1971 | Nicastro | 417/202 |
| 3,716,309 | A | * | 2/1973 | Mitchell | 417/422 |
| 3,717,421 | A | * | 2/1973 | Schaefer | 417/38 |
| 3,775,024 | A | * | 11/1973 | Ulm et al. | 415/211 |
| 4,917,304 | A | * | 4/1990 | Mazzei et al. | 239/64 |
| 5,022,585 | A | * | 6/1991 | Burgess | 239/70 |
| 5,055,006 | A | * | 10/1991 | Kobayashi et al. | 417/366 |
| 5,901,789 | A | * | 5/1999 | Donnelly et al. | 166/381 |
| 6,398,521 | B1 | * | 6/2002 | Yorulmazoglu | 417/360 |

FOREIGN PATENT DOCUMENTS

DE 43 02 978 A1 * 8/1994

* cited by examiner

*Primary Examiner*—Charles G. Freay
*Assistant Examiner*—Han L. Liu
(74) *Attorney, Agent, or Firm*—Clark Hill PLC

(57) ABSTRACT

An electrical non-priming submersible pump including a motor assembly that has a motor coupled to a shaft. The shaft has impellers formed thereon for propelling water. Also included is a housing assembly that surrounds the motor assembly. The housing assembly has an intake area that includes a multilayer sediment protection system that prevents the introduction of debris into the housing. The multi-layer sediments protection system includes a first plurality of slots positioned around the circumference of the housing assembly and a screen position in juxtaposition in relation to the first plurality of slots.

A sprinkling system is also disclosed including an electrical non-priming submersible pump that is connected to a control panel which is connected to a header pipe section. The header pipe section is connected to a zone pipe section that includes sprinkler heads for applying water to a desired location.

26 Claims, 3 Drawing Sheets

SUBMERSIBLE PUMP AND SPRINKLER SYSTEM

FIELD OF THE INVENTION

The present invention pertains to the field of underground sprinkling systems. More particularly, the present invention pertains to underground sprinkler systems operating using a pump. Even more particularly, the present invention pertains to underground sprinkler systems operated using a non-priming submersible pump with housing.

BACKGROUND OF THE INVENTION

Persons living on a body of water often utilize the water as a source for sprinkling lawns and/or gardens to avoid having to pay water utility charges to maintain their horticulture.

Generally to implement such a watering system a pump is used to draw water from a source and pump it through a network of underground pipes to be dispensed through sprinkler heads. The pump generally utilized is a centrifugal type pump that requires "priming" before it can be operated.

Priming the pump involves drawing water through a feed pipe into the pump, until all of the air is removed from the feed pipe and the cavity of the pump. Running the pump when there is air within the system can cause damage to the pump as well as to the sprinkling system.

Generally the pump must be primed before each use, as the system usually drains when not running. It is undesirable to have to prime a pump each time one wishes to utilize the sprinkling system. It is also undesirable to have to wait until the underground network of pipes becomes filled with water, before operating the system under full operating pressure to avoid damage to the sprinkling heads.

A multitude of submersible pumps with housings have been disclosed to the public as water pumping means, including those disclosed in U.S. Pat. No. 5,205,725 (A Top Suction Pump Including a Pump Housing) and U.S. Pat. No. 4,693,271 (A Horizontally Mounted Submersible Pump Assembly).

Neither of the reference patents teaches a pump and housing assembly suitable for use in a sprinkling system utilizing a non-municipal water source such as a lake or other such water source. Specifically, U.S. Pat. No. 5,205,725 teaches a pump and housing assembly for use in a sump. The vertical orientation of the pump is not suitable in a lake environment, due to the possibility of clogging due to weeds and other debris commonly found in such an environment.

U.S. Pat. No. 4,693,271 teaches a horizontally mounted pump assembly for pumping water from water storage tanks. Again, the pump assembly would not be suitable for use in a lake environment, because it has no design features to avoid clogging by debris, and is specifically designed for use for transferring water from storage tanks.

It is therefore, the purpose of the present invention to cure those deficiencies outlined above by providing a non-priming submersible pump assembly suitable for use in a lake environment to provide water for a sprinkling system.

SUMMARY OF THE INVENTION

In a first aspect of the present invention, there is disclosed an electrical non-priming submersible pump that includes a motor assembly that has a motor coupled to a shaft. The shaft has impellers associated therewith for propelling water.

There is also included a housing assembly that surrounds the motor assembly. The housing assembly has an intake area that includes a multi-layer sediment protection system that prevents the introduction of debris into the housing as well as prevents the build-up of sediment on the exterior of the housing.

In a second aspect of the invention, there is disclosed a sprinkling system that includes an electrical non priming submersible pump, a control panel in communication with the pump to regulate liquid flow, a first means for connecting the pump to the control panel, a header pipe section, a second means for connecting the control panel to the header pipe section, at least one zone pipe section connected to the header pipe section, and at least one sprinkler head interposed within the at least one zone pipe section to supply water to a desired location.

DETAILED DESCRIPTION OF THE PREFERRED EMBODIMENT

Figure 2:
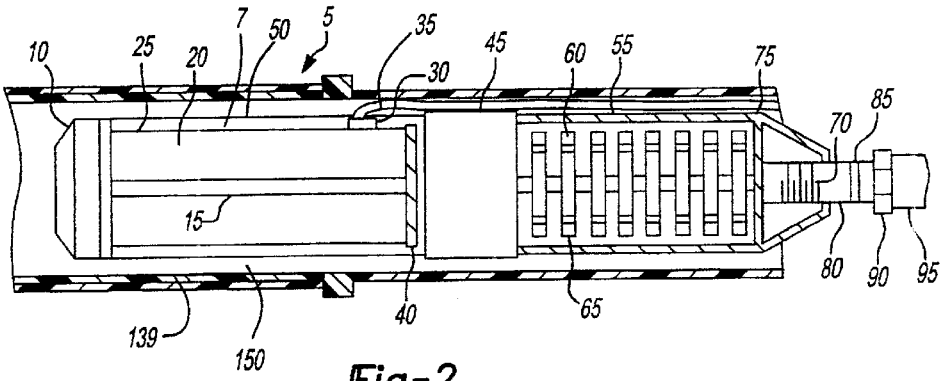
FIG. 2 is a side sectional view of a preferred embodiment of a pump assembly.
Figure 7:
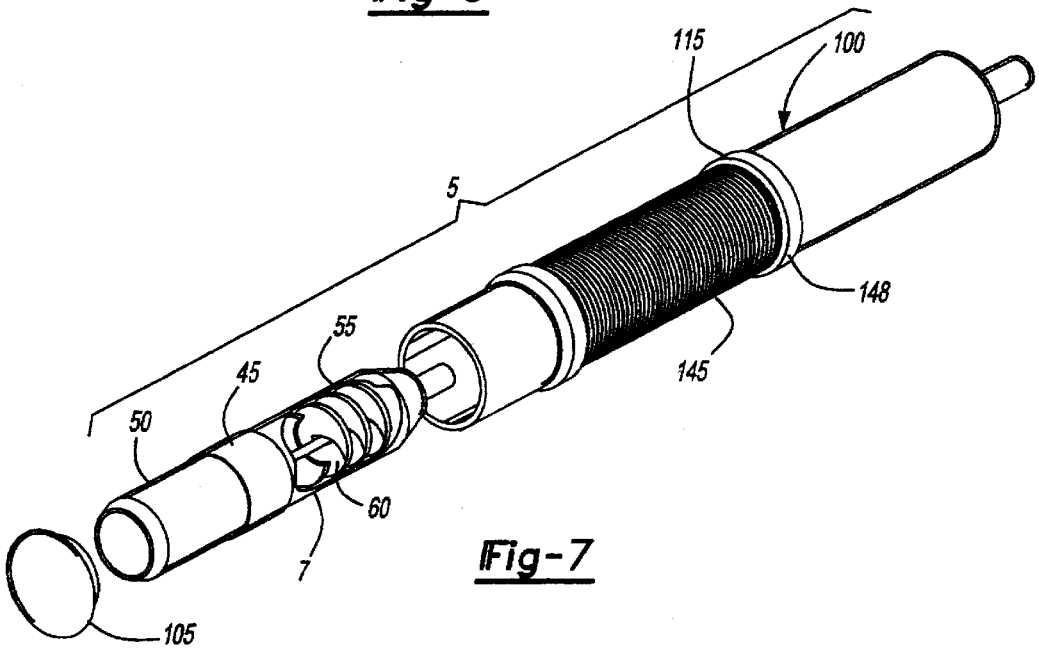
FIG. 7 is an isometric view of the pump detailing the motor assembly and housing assembly.

With reference to FIGS. 2 and 7, there is a shown a preferred embodiment of a pump, denoted at 5, used in the invention. The pump 5 includes a motor assembly 7, and a housing assembly 100.

The motor assembly 7 includes a first bearing assembly 10 located at the rear of the motor assembly 7 and in communication with a motor shaft 15. The motor shaft 15, in a preferred embodiment, is made of stainless steel, but substitution of a suitable non-corrodible material can alternatively be used by the present invention. The motor shaft 15 is linked with an electric motor 20, to apply rotational force to the motor shaft 15. In a preferred embodiment, the electric motor 20 is of the 110-volt variety, capable of running on standard house current within the United States.

A motor 20 utilizing another current, such as a 220-volt variety can alternatively be used by the present invention. The motor 20 is encased in a watertight motor housing 25 to protect the electric motor from exposure to water. Within the motor housing 25 there is provided a coupling 30 which allows for the passage of a shielded electric supply cable 35 to connect with the electric motor 20 to provide a source of electric power for the motor 20. The coupling 30 allows for the passage of the cable while maintaining a watertight seal to prevent intrusion of liquid into the motor housing 25. At another end of the shielded electric supply cable 35 there is provided a GFI switch (not shown) to protect against electrocution. The GFI switch is also in communication with a source of power. GFI switches are known in the art to provide protection from electrical shock when an electric system is used in the proximity of water. The GFI switch cuts power to the electrical unit should there be a short circuit due to exposure to water.

The motor shaft 15 further extends from the motor 20 through the motor housing 25 and is in communication with a second bearing assembly 40.

There is provided a motor intake screen 45 positioned between the motor unit 50 and the impeller unit 55 of the motor assembly 7. The screen provides a barrier to filter debris and to prevent entry of debris into the impeller unit 55. The motor shaft 15 further extends from the second bearing assembly 40 through the intake screen 45 and projects into the impeller unit 55. In a preferred embodiment, there are provided 8 impeller blades 60 that are permanently affixed along the motor shaft 15 at uniform intervals. It is to be appreciated that a different number of impeller blades can alternatively be utilized by the present invention. Each impeller blade 60 has a pair of cerated fins 65 affixed to the blade at a uniform diameter from the center of the blade. The cerated fins 65 are biased at an angle relative to the impeller blade to propel water in a direction toward the threaded opening 70 of the pump 5. Each impeller blade 60 has a pair of cerated fins 65 that are placed at a different diameter on the blade 60 relative to each of the other impeller blades 60. This alignment provides for a more proficient propulsion of the water as the fins 65 cover a greater cross section within the impeller unit 55.

The shaft 15 further extends toward the threaded opening of the pump 5 and is in communication with a third bearing assembly 75.

As previously recited, there is provided a threaded opening 70 to allow for passage of water from the impeller unit 55 into a feed shaft 80 that is threadably engaged with the threaded opening 70. There is provided within the feed shaft 80 a check valve assembly 85 to prevent backflow of water when the pump 5 is not in operation. There is also provided a coupling union 90 for securely engaging a feed line 95 to deliver water to a desired location.

Figure 1:
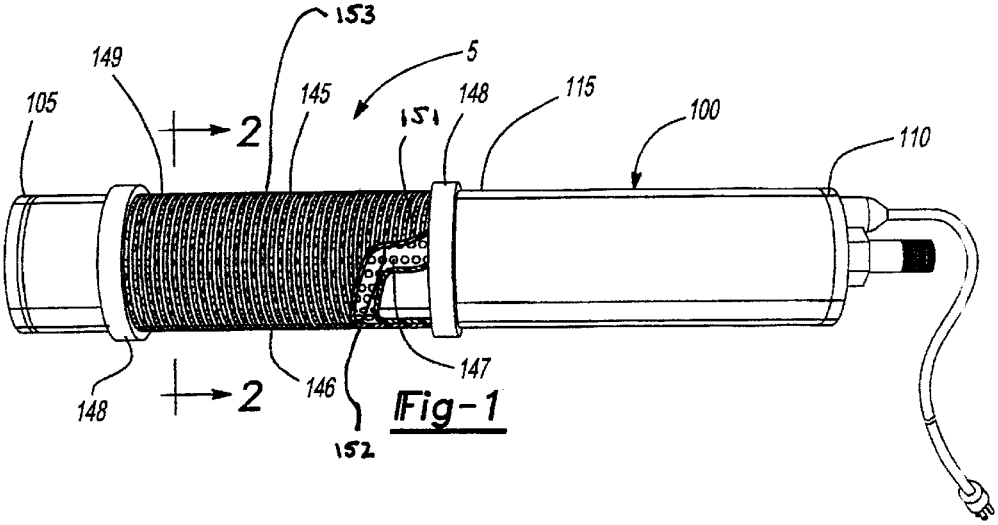
FIG. 1 is a side sectional view with a cutaway disclosing the intake area.
Figure 3:
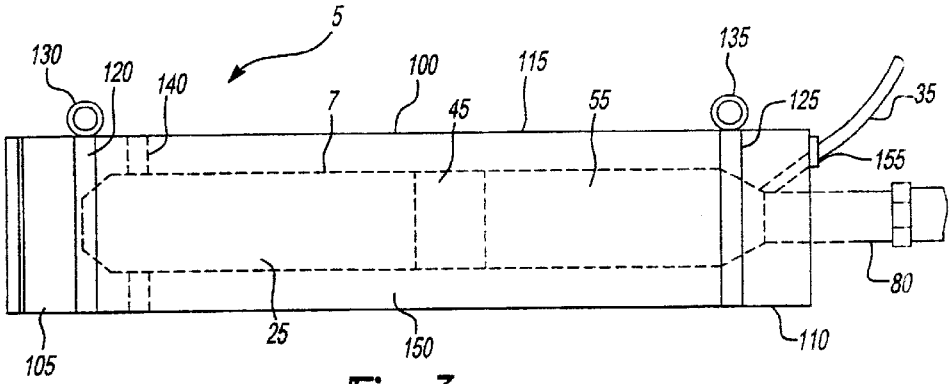
FIG. 3 is a side view of the housing of the pump showing the motor assembly in phantom.

With reference to FIGS. 1, 3 and 7 there is shown a housing assembly 100, with a first end cap 105 and a second end cap 110 and a main body portion 115 securely positioned there between.

In a preferred embodiment, the first 105 and second 110 end caps are securely fastened to the main body 115 by a friction fit. The ends of the end caps that are to join with the main body are tapered so that they may be inserted within the main body a sufficient distance to frictionally engage the two parts.

With reference to FIG. 3, there is disclosed in a preferred embodiment a first retaining band 120 and a second retaining band 125 that encircles the joint where the first 105 and second 110 end caps engage the main body 115, to further maintain the union of the parts. There is also provided a first eyelet 130 and a second eyelet 135 attached to the first and second retaining bands respectively to facilitate the hanging of the pump 5 from a dock structure.

Again with reference to FIG. 3, there is shown, via hidden lines, disposed centrally within the housing assembly 100 the motor assembly 7. The motor assembly 7 is maintained centrally by a mounting bracket 140 at one end. The mounting bracket 140 is substantially cross-shaped and engages the motor housing 25 at 4 points to provide support. The mounting bracket 140 further engages the inside wall 139 of the main body section 115 to prevent movement of the motor assembly 7 within the housing assembly 100. The mounting bracket 140 is designed to accommodate various sized motor assemblies 7 within the housing assembly 100. The other end of the motor assembly 7 is maintained in a central position within the housing assembly 100 by the feed shaft 80.

Figure 6:
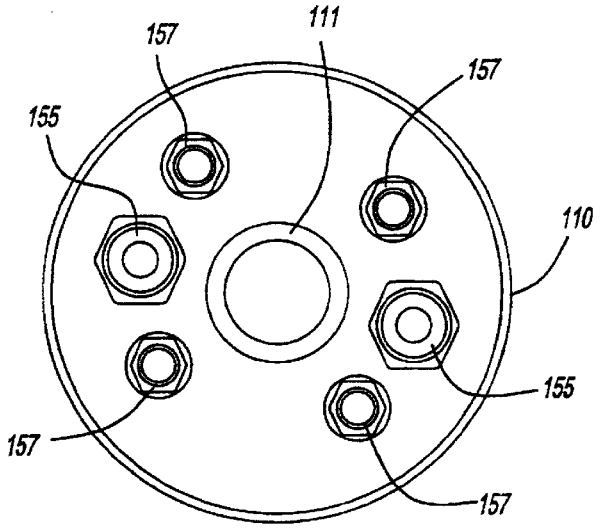
FIG. 6 is a top view detailing an end cap of the housing of the present invention.

With reference to FIG. 6 there is provided within the second end cap 110 a centrally located hole 111 of a diameter to allow passage of the feed shaft 80 therethrough. The feed shaft 80 engages the second end cap 110 through the hole 111 to support the motor assembly 7 in a central position. There is also provided within the second end cap 110 a hold and coupling 155 to allow for entry of the shielded electrical supply cable 35 to the motor assembly 7. As can be seen in FIG. 6, there are multiple holes and couplings 155 to facilitate the various arrangements for entry of the shielded electrical supply cable 35. Also shown in FIG. 6, are a plurality of access ports 157 having threaded fasteners removably attached to allow for entry of various articles into the housing 100.

With reference to FIGS. 1 and 7, there is provided an intake area 146 positioned near a rear portion of the housing assembly 100. The intake area 146 includes a multi-layer sediment protection system 145 for preventing the introduction of debris into the housing assembly 100 and subsequently into the motor assembly 7. The multi-layer sediment protection system 145 has a first plurality of slots 147 positioned around the circumference of the housing assembly 100. As best seen in FIG. 1, the first plurality of slots 147 are generally circular and extend through the housing assembly 100. It is to be understood that other shaped slots including ovoid, square, triangular, and other polygonal shaped slots may be utilized by the present invention.

A set of retaining rings 148 hold a screen 149 which has first 151 and second 152 surfaces. The screen 149 is maintained in a position over the intake area 145. The second surface 152 of the screen 149 is juxtaposition to the first plurality of slots 147. The screen 149 has a second plurality of slots 153 formed therein. The second plurality of slots has a smaller size then that of the first plurality of slots 147. The second pluralities of slots 153 are beveled such that the second plurality of slots 153 have an opening area that is larger at the second surface 152 then that at the first surface 151. This arrangement of slots 153 and 147 prevents the entrance of debris from an outside environment, as well as, facilitates an even flow of water into the housing assembly 100.

After water enters the inlet area 145 through the first 147 and second 153 slots it travels in an annular area 150, as best seen in FIG. 2, that is defined by an inside wall 139 of the housing assembly 100 and the motor assembly 7. The water is drawn into the motor assembly 7 through the intake screen 45 and into the impeller unit 55. The impeller unit 55 imparts a forward motion to the water, such that it may be transported to a desired location.

Figure 4:
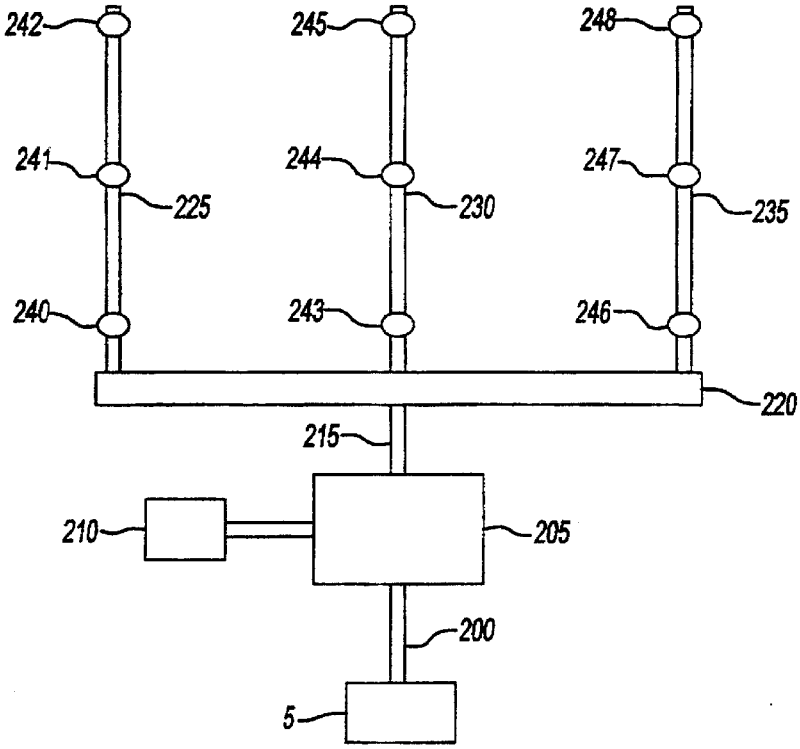
FIG. 4 is a diagram of a preferred embodiment of sprinkling system utilizing the pump of the present invention.
Figure 5:
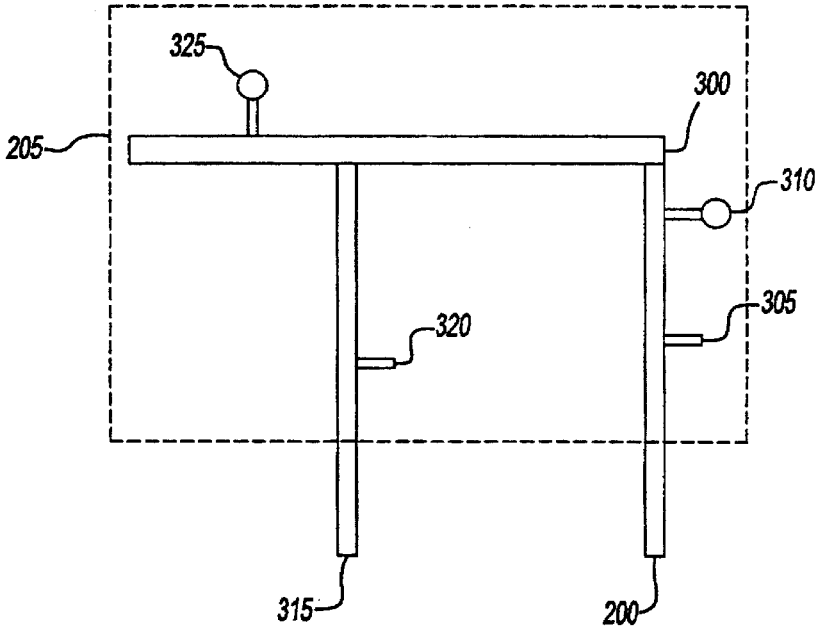
FIG. 5 is a diagram of the control panel system of the sprinkling system.

FIGS. 4 and 5 are diagrams of the preferred embodiment of the sprinkling system of the present invention.

As shown in FIG. 4 there is provided a pump 5 and a first means for connecting 200 for connecting the pump 5 to a control panel 205. In a preferred embodiment, the control panel 205 is in communication with a sprinkler time clock 210 to automatically operate the sprinkling system at preset time intervals. The control panel 205 is further connected to a second means for connecting 215 a control panel to a header pipe section 220.

In a preferred embodiment of the present invention, there is shown a first zone pipe section 225, a second zone pipe section 230, and third zone pipe section 235 connected to the header pipe section 220. While the illustrated embodiment utilizes three zone pipe sections, it is to be understood that any number of zone pipe sections may be utilized by the present invention. A plurality of sprinklered heads shown as numbers 240 through 248 are interposed within the zone pipe sections to apply water to a desired location.

FIG. 5 is a diagram of the control panel system of the present invention. As shown in FIGS. 4 and 5, there is a first means for connecting 200 the pump to the control panel 205. Within the control panel 205 there is a sprinkler means for connecting 300 that connects to the first means for connecting 200 at one end and a second means for connecting 215 at the other end. There is included a pressure relief valve 305 within the means for connecting 300 which is preset to a desired range to provide a safety relief means for the sprinkling system should the pump pressure exceed a certain range. There is also included within the sprinkler means for connecting 300 a first pressure gauge 310 to monitor the water pressure entering the control panel 205.

There is also detailed a bypass means for connecting 315 to the sprinkler means for connecting 300 to allow for a return of water for the lake or other source of water. The bypass means for connecting 315 allows for regulating the pressure and capacity of water within the sprinkling system. There is also shown a back pressure valve assembly 320 that is interposed within the bypass means for connecting 315 to adjust the amount of water being returned to the lake or source of water.

Finally, there is also shown a second pressure gauge 325 that is interposed within the sprinkler means for connecting 300 after the bypass means for connecting 315 to monitor the water pressure entering the sprinkler system via the second means for connecting 215.

While the invention isn't illustrated in detail in the drawings and in the foregoing description, the same is to be consider as illustration and not restrictive in nature. It is understood that only the preferred embodiments have been shown and described fully and that all changes and modifications that come within the spirit of the invention are desired to be protected.

What is claimed is:

1. An electrical non-priming submersible pump comprising:

a pump, said pump comprising:

a) a motor assembly comprising a motor coupled to a shaft, said shaft having impellers associated therewith for propelling water; and b) a housing assembly surrounding said motor assembly, said housing assembly having an intake area including a multi-layer sediment protection system comprising a first plurality of slots separated from a second plurality of slots, said first plurality of slots having a different size than said second plurality of slots for preventing the introduction of debris into said housing and for preventing the build-up of sediment on an exterior of said housing.

2. The electrical non-priming submersible pump of claim 1 wherein the first plurality of slots is positioned circumferentially and formed through said housing assembly in said intake area, and wherein a screen having first and second surfaces is positioned over said intake area, said second surface of said screen in juxtaposition to said first plurality of slots.

3. The electrical non-priming submersible pump of claim 2 wherein said screen includes the second plurality of slots extending from said first surface through to said second surface, said second plurality of slots having a size smaller than said first plurality of slots.

4. The electrical non-priming submersible pump of claim 3 wherein said second plurality of slots are beveled such that said second plurality of slots have an opening area that is larger at said second surface than at said first surface.

5. The electrical non-priming submersible pump of claim 4 wherein said screen is made of a non-corroding plastic having slots with a nominal size of 20 one thousandths of an inch.

6. The electrical non-priming submersible pump of claim 1 wherein said pump further includes a mounting bracket associated with said motor assembly and engaging an inside wall of said housing assembly to maintain said motor assembly centrally within said housing assembly.

7. The electrical non-priming submersible pump of claim 6 wherein said mounting bracket is adjustable to accommodate various size motor assemblies centrally within said housing assembly.

8. The electrical non-priming submersible pump of claim 6 wherein said motor assembly is further maintained in a central relation with said housing assembly by a feed shaft associated with an end cap of said housing assembly.

9. The electrical non-priming submersible pump of claim 1 wherein said motor is positioned forward in relation to said intake area for cooling said motor utilizing a flow of water from said intake area.

10. An electrical non-priming submersible pump comprising:

a pump, said pump comprising:

a) a motor assembly comprising a motor coupled to a shaft, said shaft having impellers associated therewith for propelling water; and b) a housing assembly surrounding said motor assembly, said housing assembly having an intake area including a multi-layer sediment protection system for preventing the introduction of debris into said housing and for preventing the build-up of sediment on an exterior of said housing, wherein said multi-layer sediment protection system comprises a first plurality of slots separated from a second plurality of slots, said first plurality of slots having a different size than said second plurality of slots and wherein said first plurality of slots is positioned circumferentially and formed through said housing assembly in said intake area, and wherein a screen having first and second surfaces is positioned over said intake area, said second surface in juxtaposition to said first plurality of slots.

11. The electrical non-priming submersible pump of claim 10 wherein said screen includes a second plurality of slots extending from said first surface through to said second surface, said second plurality of slots having a size smaller than said first plurality of slots.

12. The electrical non-priming submersible pump of claim 11 wherein said second plurality of slots are beveled such that said second plurality of slots have an opening area that is larger at said second surface than at said first surface.

13. The electrical non-priming submersible pump of claim 12 wherein said screen is made of a non-corroding plastic having slots with a nominal size of 20 one thousandths of an inch.

14. The electrical non-priming submersible pump of claim 10 wherein said pump further includes a mounting bracket associated with said motor assembly and engaging an inside wall of said housing assembly to maintain said motor assembly centrally within said housing assembly.

15. The electrical non-priming submersible pump of claim 14 wherein aid mounting bracket is adjustable to accommodate various size motor assemblies centrally within said housing assembly.

16. The electrical non-priming submersible pump of claim 14 wherein said motor assembly is further maintained in a central relation with said housing assembly by a feed shaft associated with an end cap of said housing assembly.

17. The electrical non-priming submersible pump of claim 10 wherein said motor is positioned forward in relation to said intake area for cooling said motor utilizing a flow of water from said intake area.

18. A sprinkling system comprising:

a) an electrical non-priming submersible pump comprising:

a pump, said pump comprising:

b) motor assembly comprising a motor coupled to a shaft, said shaft having impellers associated therewith for propelling water; and c) a housing assembly surrounding said motor assembly, said housing assembly having an intake area including a multi-layer sediment protection system comprising a first plurality of slots separated from a second plurality of slots, said first plurality of slots having a different size than said second plurality of slots for preventing the introduction of debris into said housing and for preventing the build-up of sediment on an exterior of said housing;

d) a control panel in communication with said pump for regulating liquid flow;

e) first means for connecting the pump to the control panel;

f) a header pipe section g) a second means for connecting said control panel to said header pipe section;

h) at least one zone pipe section connected to said header pipe section; and i) at least one sprinkler head interposed within the at least one zone pipe section for applying water to a desired location.

19. The sprinkling system of claim 18 wherein the first plurality of slots is positioned circumferentially and formed through said housing assembly in said intake area, and wherein a screen having first and second surfaces is positioned over said intake area, said second surface of said screen in juxtaposition to said first plurality of slots.

20. The sprinkling system of claim 19, wherein said screen includes the second plurality of slots extending from said first surface through to said second surface, said second plurality of slots having a size smaller than said first plurality of slots.

21. The sprinkling system of claim 20 wherein said second plurality of slots are beveled such that said second plurality of slots have an opening area that is larger at said second surface than at said first surface.

22. The sprinkling system of claim 21 wherein said screen is made of a non-corroding plastic having slots with a nominal size of 20 one thousandths of an inch.

23. The sprinkling system of claim 18 wherein said pump further includes a mounting bracket associated with said motor assembly and engaging an inside wall of said housing assembly to maintain said motor assembly centrally within said housing assembly.

24. The sprinkling system of claim 23 wherein aid mounting bracket is adjustable to accommodate various size motor assemblies centrally within said housing assembly.

25. The sprinkling system of claim 23 wherein said motor assembly is further maintained in a central relation with said housing assembly by a feed shaft associated with an end cap of said housing assembly.

26. The sprinkling system of claim 18 wherein said motor is positioned forward in relation to said intake area for cooling said motor utilizing a flow of water from said intake area.

* * * * *